US006220564B1

(12) United States Patent
Costello

(10) Patent No.: US 6,220,564 B1
(45) Date of Patent: Apr. 24, 2001

(54) CONCRETE COLUMN FORMING TUBE

(76) Inventor: James Costello, 195 West Hills Rd., Huntington Station, NY (US) 11746

( * ) Notice: Subject to any disclaimer, the term of this patent is extended or adjusted under 35 U.S.C. 154(b) by 0 days.

(21) Appl. No.: 09/523,709

(22) Filed: Mar. 13, 2000

(51) Int. Cl.[7] ..... E04G 9/08; E04G 13/02; E02D 5/34

(52) U.S. Cl. ..... 249/48; 249/51; 249/188; 52/721.4; 52/742.1; 52/745.18; 229/4.5; 229/93

(58) Field of Search ..... 249/48, 51, 143, 249/188; 52/721.4, 742.14, 745.18; 217/44; 229/4.5, 67, 93

(56) References Cited

U.S. PATENT DOCUMENTS 1,060,304 * 4/1913 Woodley .
2,194,833 * 12/1940 Hart, Jr. et al. .
2,491,213 * 12/1949 Robinson, Jr. .
2,670,129 * 2/1954 Baxter et al. .
4,846,394 * 7/1989 Swanson ..... 229/4.5
5,328,142 * 7/1994 Weekers ..... 249/48

* cited by examiner

*Primary Examiner*—Robert Canfield
(74) *Attorney, Agent, or Firm*—Myron Amer PC

(57) ABSTRACT

A concrete column forming tube stored and displayed for sale in the flat, and under the urging of a pivotal traverse of an internal ring is projected into the much larger three dimensional shape necessary for forming the concrete column, this reshaping occurring at a site of use having no space limitations.

1 Claim, 1 Drawing Sheet

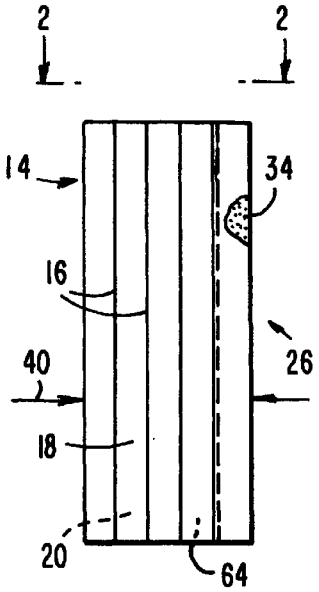
FIG. 1
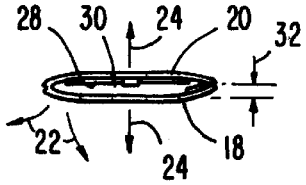
FIG. 2
FIG. 3
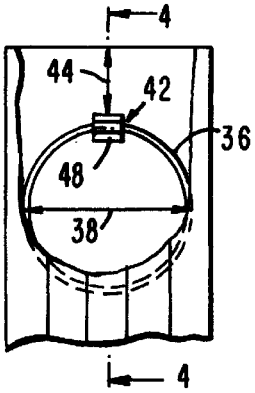
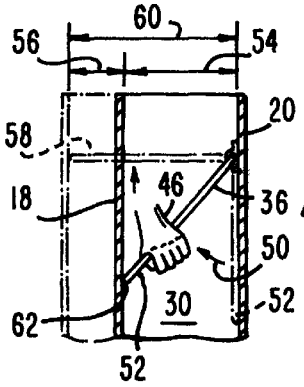
FIG. 4
FIG. 5
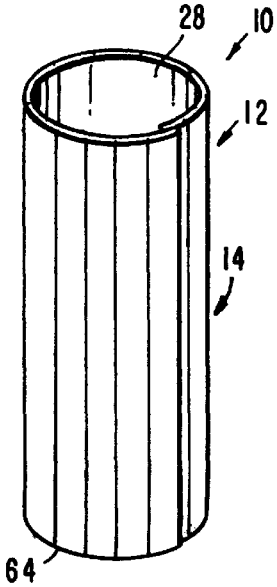
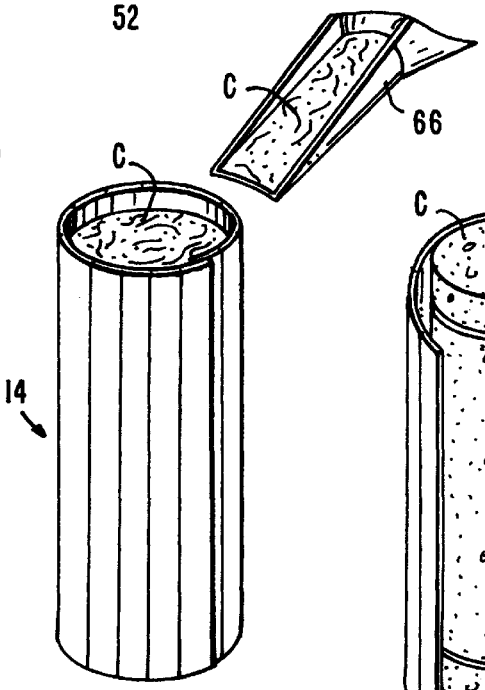
FIG. 6
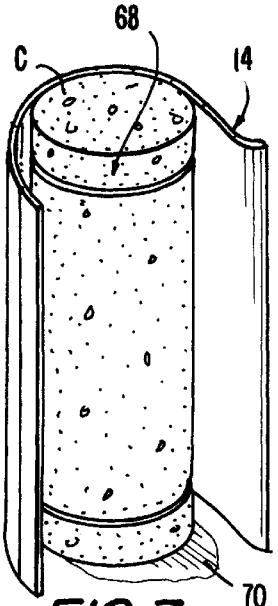
FIG. 7

CONCRETE COLUMN FORMING TUBE

The present invention relates to improvements for a concrete column forming tube, the improvements more particularly facilitating the reshaping of the flat tub from a convenient-to-handle non-use condition into a three dimensional configuration as required at a construction site to achieve the end purposes intended.

Example of the Prior Art

In the construction art, in which concrete is poured into a circular void of a column forming tube to produce, after the concrete cures, a support for a concrete floor, outdoor porch or patio or the like, that a rigid tube bounding the shape-imparting void is not a handling problem at the site of use. However, at a site of sale, or in warehouse storage, the three dimensional tube size, typically 48 inches long and 13 inches in diameter, takes up valuable space, as well as complicating transit from a remote site to the site of use location.

Solutions addressing the problem abound in the patent literature, as exemplified by U.S. Pat. No. 5,328,142 for Concrete Column Forming Tube issued to Weekers on Jul. 12, 1994. In the '142 patent, the cardboard construction material in strip form is helically wound on a mandrel-like roller, shipped in such condition presumably to a site of use, and then unwound preparatory to being constructed into a three dimensional concrete molding configuration.

In the '142 patent and in all other known patents, in respect to the non-use condition of the forming tube at a site of sales, a very significant location and occurrence in the travel of trade of the product from a manufacturer to the ultimate consumer, said non-use condition does not adequately display the product with a consumer cognitive appreciation of its ultimate utility in the construction process. The helically wound strip of cardboard put up on supply roll of the '142 is a case in point.

Broadly, it is an object to provide a concrete column forming tube overcoming the foregoing and other shortcomings of the prior art.

More particularly, it is an object to embody a concrete column forming tube of cardboard construction material with a flat configuration in non-use, and readily reshaped, using folds, an expedient of choice of cardboard constructed articles of manufacture, into an effective three dimensional configuration, by the mere unfolding of the folds, at a site of use, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a front elevation view of a concrete column, i.e., circular shaped, forming tube in a compact flat storage or non-use condition;

FIG. 2 is a top plan view of the concrete column forming tube of FIG. 1, as seen in the direction 2—2 of FIG. 1;

FIG. 3 is a partial view of the FIG. 1 concrete column forming tube with a portion thereof broken away to illustrate internal constructural features;

FIG. 4 is a view taken along line 4—4 of FIG. 3, illustrating in full line and phantom line positions of movement of a ring component in the reshaping of the tube from a flat nonuse storage condition of FIG. 1 into a three dimensional in-use condition at a site of use; and FIGS. 5, 6 and 7 are perspective views of the three dimensional in-use condition of the FIG. 1 concrete column forming tube illustrating in sequence how it is typically put to use at a construction site.

As know by common experience, concrete structures such as concrete floors, a plywood deck or the like, are supported on concrete columns that are formed or molded into their circular column shape using a correspondingly circular void in a circular shaped form. The shaping form at the site of use is, of course, of three dimensional shape that poses no problem because there is no space limitations at the site of use. However, at a site of sale or in storage, the three dimensional shape of the shaping form is a significant problem and inconvenient, particularly in handling and transport from a site of manufacture to sites of sale and use.

As a solution to the problem noted, use is made of a concrete column forming open ended tube, generally designated 10, of cardboard construction material which in-use, as depicted in FIGS. 5, 6 and 7, has a circular configurated shape, as noted at 12, imparted to the tube body 14. Plural longitudinally oriented folds, individually and collectively designated 16, are circumferentially spaced about the body, in this case being ten in number, five in a front wall 18 and five in a rear wall 20, and, as is generally known each fold 16 is a construction which when unfolded in the direction 22 will project the walls 18 and 20 in separating movement 24 and into the three dimensional body shape of FIGS. 5, 6 and 7. The use of unfolding folds is in common use in structures of cardboard construction material, such as the attaching means of choice of attaching opening and closing panels of a cardboard shipping box.

Prior to the unfolding of the folds 16, body 14 has a flat configuration, denoted at 26 and as best depicted in FIGS. 1 and 2, in which the walls 18 and 20 bound an opening 28 into a compartment 30. The size of opening 26 is shown slightly exaggerated in FIG. 2, but in practice will consist of the two plies constituting the walls 18, 20 and delimiting a nominal thickness 32 in the flat configurated FIGS. 1, 2 body shape which contributes to a noteworthy desirable compact condition for storage, point of sale display, ease of transport and other benefits. As best understood from FIG. 1 a glue flap 34 is adhesively secured beneath a border along an edge of the blank of the tube to convert the blank into a closed loop configuration.

To reshape the body 14 from its FIG. 1 storage condition into its in-use FIGS. 5, 6 and 7 circular condition, use is made of a ring 36 having a diameter 38 approximately the size of the width 40 of the FIG. 1 depicted body 14. In any appropriate manner, the ring 36 is attached as at 42 at a distance 44 in which it is conveniently reachable to a user inserting a hand 46 through the opening 28 and grasping the ring 36. As best understood from FIG. 2, the attachment at 42 is preferred to be achieved using a simple adhesive patch 48 which allows for a pivotal traverse 50 in the grasped ring 36. Thus, in the pivotal traverse, an initial position of movement 52 projects the front wall 18 in a clearance distance 54 in front of the rear wall 20, and in the subsequent portion of the pivotal traverse projects the front wall 18 the additional distance 56, so that in a horizontally oriented position of movement, as at 58, the full clearance distance 60 is approximately equal to the diameter 38 of the ring 36. Preferably, the diameter 38 of the ring is slightly oversized with respect to the clearance distance 60 so that there is frictional resistance to movement at the site of contact 62 which, in practice holds the ring 36 in place.

In addition to use of the installed ring 36 in the compartment 30 adjacent the opening 28, it will be understood that a similar ring, similarly installed, adjacent the bottom opening 64 is recommended, but not essential to the forming of the concrete column forming tube 10.

For completeness sake, the circular configurated tube 14 of FIG. 6 is put to use by being filled, as depicted on FIG. 7 with concrete via a chute 66 or other conveyor system, into the open circular void or shaping compartment 30. The concrete C is then allowed to cure, and the tube 10 is then removed from the formed concrete column 68. Such removal may be effected by simply cutting the tube with a knife, as illustrated in FIG. 7.

As described, the concrete column 68 is formed on an external surface 70 adjacent a column-receiving footing opening (not shown), but the forming thereof can readily be achieved insitu.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A concrete column forming tube comprising an in-use circular configurated body of cardboard construction material having plural longitudinally oriented folds in circumferentially spaced relation thereabout operatively effective to impart said in-use circular configuration incident to unfolding of said folds, a non-use flat configuration of said body prior to said unfolding of said folds consisting of opposite front and rear walls bounding a compartment therebetween and a delimited minimal thickness in said body contributing to a compact storage condition thereof, at least one ring of metal construction material of a selected diameter approximately equal to a diameter of said circular configurated body, and hinge means attaching said ring in said compartment with a pivotal traversing degree of movement, whereby the urging of said ring in a pivotal traverse reshapes said body from its flat storage condition to its circular in-use condition.

* * * * *